US007025622B2

(12) United States Patent
Leitl et al.

(10) Patent No.: US 7,025,622 B2
(45) Date of Patent: Apr. 11, 2006

(54) CONTACT ELEMENT TERMINAL WITH A CONTACT ELEMENT AND METHOD FOR CONTACTING A CONDUCTOR WITH A CONTACT ELEMENT

(75) Inventors: Wolfgang Leitl, Wenzenbach (DE); Christoph Weber, Ergoldsbach (DE)

(73) Assignee: Siemens Aktiengesellschaft, Munich (DE)

( * ) Notice: Subject to any disclaimer, the term of this patent is extended or adjusted under 35 U.S.C. 154(b) by 188 days.

(21) Appl. No.: 10/471,090

(22) PCT Filed: Mar. 4, 2002

(86) PCT No.: PCT/DE02/00785

§ 371 (c)(1),
(2), (4) Date: Sep. 8, 2003

(87) PCT Pub. No.: WO02/073745

PCT Pub. Date: Sep. 19, 2002

(65) Prior Publication Data

US 2005/0020145 A1 Jan. 27, 2005

(30) Foreign Application Priority Data

Mar. 8, 2001 (DE) ..... 101 11 190

(51) Int. Cl.
*H01R 11/20* (2006.01)

(52) U.S. Cl. ..... 439/412

(58) Field of Classification Search ..... 439/412, 439/411, 431, 433, 791, 811, 812, 810, 814
See application file for complete search history.

(56) References Cited

U.S. PATENT DOCUMENTS

| | | | |
|---|---|---|---|
| 3,895,852 | A | 7/1975 | Wasserlein, Jr. |
| 3,914,004 | A | 10/1975 | Bone |
| 4,973,262 | A | 11/1990 | Gerke et al. |
| 5,277,616 | A | 1/1994 | Harting et al. |

FOREIGN PATENT DOCUMENTS

| | | |
|---|---|---|
| DE | 2 325 756 | 12/1973 |
| DE | 23 42 408 B2 | 3/1974 |
| DE | 28 25 121 A1 | 12/1979 |
| DE | 2643471 | 8/1980 |
| DE | 3216096 | 11/1983 |
| DE | 8604746 | 5/1986 |
| DE | 38 32 497 C1 | 4/1989 |
| DE | 38 20 074 A1 | 12/1989 |
| DE | 42 03 455 C1 | 6/1993 |
| FR | 7507888 | 10/1976 |
| GB | 2185159 | 7/1987 |
| NL | 6910268 | 4/1970 |

*Primary Examiner*—Phuong Dinh
(74) *Attorney, Agent, or Firm*—Harness, Dickey & Pierce, P.L.C.

(57) ABSTRACT

The contact element is provided with a simple base body that includes a recess for accommodating a first conductor. When a first conductor is accommodated inside the recess, an electrically conductive connection is established between the base body and the first conductor by rupturing the insulation of said conductor.

16 Claims, 3 Drawing Sheets

CONTACT ELEMENT TERMINAL WITH A CONTACT ELEMENT AND METHOD FOR CONTACTING A CONDUCTOR WITH A CONTACT ELEMENT

This application is the national phase under 35 U.S.C. § 371 of PCT International Application No. PCT/DE02/00785 which has an International filing date of Mar. 4, 2002, which designated the United States of America and which claims priority on German Patent Application number DE 101 11 190.8 filed Mar. 8, 2001, the entire contents of which are hereby incorporated herein by reference.

FIELD OF THE INVENTION

The present invention generally relates to a contact piece having a base body, which has a recess for holding a conductor, additionally to a connecting terminal having a contact piece, and to a method for making contact between a conductor and a contact piece.

BACKGROUND OF THE INVENTION

A contact piece of the generic type mentioned above is generally used for connection of an electrical conductor. This is done by making contact with a conductor core and, possibly, by passing through conductor insulation prior to making contact. The contact can also be made in conjunction with other contact or clamping tech. The field of use extends from installation technology to telecommunications technology.

Conventional contact or clamping technology such as a connecting terminal, an insulation-displacement terminal or else an insulation-displacement terminal contact are equally used for the connection of electrical conductors. With regard to reducing the financial cost of producing contact or clamping technology, it is desirable to use as few components, as possible, with these components being as simple as possible. However, on the other hand, it is necessary to make a sufficiently reliable contact with the electrical conductor by way of a contact or clamping technology.

DE 26 43 471 C3 discloses a connecting terminal being composed of a terminal body made of material in the form of strip. The terminal body in this case forms a rest for a conductor that is to be connected. The terminal body also has a clamping screw, which is screwed into a thread in the terminal body.

The terminal body in this case holds the clamping screw centrally in the strip material. Side limbs are bent back until they approximately touch at their end, thus guiding the clamping screw, and in their flanks have recesses which form a web as a rest. On the basis of design features, this connecting terminal can be associated with the category of female connectors or else clip terminals.

DE 86 04 746 U discloses what is referred to as an insulation-displacement terminal for making contact with an electrical conductor wire that is sheathed with insulation. The insulation-displacement terminal comprises two cutting plates, which are aligned parallel to one another at a predetermined distance apart from one another, with a vertical slot, which is open at the top and widens in the shape of a funnel at the open end, for the insertion of the conductor wire. In this case, the cutting plates have a common baseplate at their end opposite the slot opening, which baseplate merges on one side into a connecting element, for example a spring contact. The electrical conductor wire that is sheathed with insulation is thus pressed into the open end of the slot that widens in the form of a funnel, such that the insulation is cut through by the cutting plates that are aligned parallel to one another. The cutting plates thus touch the conductor wire, resulting in an electrically conductive contact.

FR 2 304 193 also discloses a cable connector which has two projections, which are provided with cutting edges, and a screw, with the cutting edges passing through the plastic insulation on an electrical cable when the screw is tightened, and making mechanical and electrical contact with this electrical cable.

In the same way for the terminal body of the connecting terminals, it can also be said for the various variants of the insulation-displacement terminals that the complex shapes can lead to an increase in the production costs. Furthermore, in the case of conventional insulation-displacement terminals, clamping forces which occur during the clamping process and contact surfaces between the conductor core and the contact piece are in some circumstances relatively small.

SUMMARY OF THE INVENTION

An object of the present invention is to specify a contact piece which on the one hand can be produced easily and thus at low cost, while on the other hand ensures that adequate contact is made between a conductor core and the contact piece. A further aim is to specify an associated connecting terminal having the contact piece, and a method for making contact between a conductor and the contact piece.

On this basis, the contact piece can be produced and used more easily and thus with financially better manufacturing steps. The manufacturing tools are accordingly equally simple and advantageous since, for example, there is no need to form any cut as in the case of an insulation-displacement terminal.

For practical use, this contact piece offers a quick, convenient and nevertheless reliable capability for connection of a conductor since, in particular, there is no need whatsoever for any complex stripping of the conductor insulation.

The large contact surface area which is achieved by the new way of making contact between the contact piece and the conductor core to be clamped is used not least by way of a sufficiently high hard conductor materials to be used and, furthermore, allowing high clamping forces to act.

According to an exemplary embodiment of the present invention, an object is achieved by way of a connecting terminal.

The terminal frame advantageously has a single-limbed profile. This results in considerable potential savings with regard to the manufacturing materials, equipment and times to be provided.

The clamping technology is expediently in the form of a clamping screw or lever, which means that it is possible to use clamping technology which have been widely proven in practice, can be designed as required and save investment.

In a further exemplary embodiment, the terminal frame is provided with at least one further cutout, which is used as a holding space and has a first section for insertion of a further insulating conductor and a second tapered section, which is adjacent to the first section and whose diameter is of such a size that, when the clamping technology are activated, the insulation of the conductor is interrupted on its flanks, and an electrically conductive contact is made between the base body and the conductor. This further cutout is at least approximately in the form of a keyhole.

This results in a simple and quick capability for connection of at least one further conductor, for which an alternative contact technique is used. Different conductor diameters and materials can thus be clamped onto one connecting terminal, while at the same time it is possible as an option to connect one or more conductors to the connecting terminal.

The advantages mentioned above also relate in the same sense to the method.

Further scope of applicability of the present invention will become apparent from the detailed description given hereinafter. However, it should be understood that the detailed description and specific examples, while indicating exemplary embodiments of the present invention, are given by way of illustration only, since various changes and modifications within the spirit and scope of the invention will become apparent to those skilled in the art from this detailed description.

BRIEF DESCRIPTION OF DRAWINGS

The present invention will become more fully understood from the detailed description given hereinbelow and the accompanying drawings which are given by way of illustration only, and thus are not limitative of the present invention, and wherein.

DETAILED DESCRIPTION OF EXEMPLARY EMBODIMENTS

In the following text, identical parts in the figures are provided with the same reference symbols or, in the same sense, with similar reference symbols. For simplicity, the clamping technology for the connecting terminal is not illustrated in any more detail in some of the figures.

Figure 1:
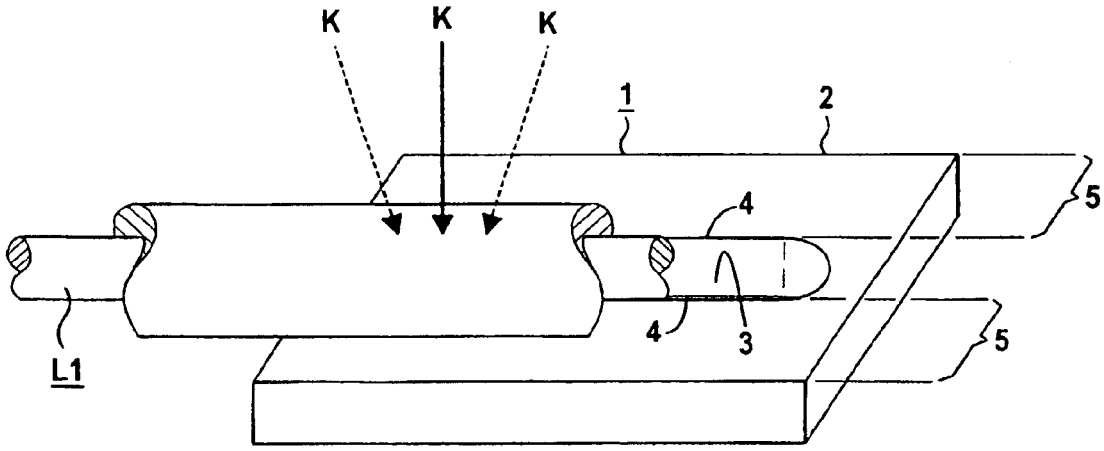
FIG. 1 shows a three-dimensional illustration of a contact piece with a conductor that is to be held.

FIG. 1 shows a three-dimensional illustration of a contact piece 1 with a first conductor L1 that is to be held. The contact piece 1 includes a base body 2, which is formed from an electrically conductive material, and whose external shape is cuboid, in a similar way to a rectangular plate.

The base body 2 is provided with a recess 3, which is used to hold the first conductor L1. The recess 3 is in this case in the form of an elongated hole, in the form of an opening which passes all the way through, that is to say an aperture, on the base body 2. The recess 3 may equally well be in the form of a groove or else a blind hole, and may be provided for different conductor diameters.

The recess 3 may be designed to be closed or open on its circumference. The base body 2 may also be designed to have different profiles, for example to be U-shaped or C-shaped.

The recess 3 is aligned parallel to the two longitudinal edges of the base body 2, and may have a radius at both ends. Limbs 5 are formed on both sides in the longitudinal direction of the recess 3 and have contours whose shapes are matched to those of the cutout 3, and of which at least one contour has a longitudinal edge 4. The longitudinal edge 4 is used as a shear, cutting, insulating stripping, displacement or else interruption edge.

The first conductor L1 which is to be held can be positioned parallel to the axis, and partially or completely on the cutout 3, or overlapping the cutout 3, in the longitudinal direction of the recess 3. The recess 3 is in this case designed to hold at least part of the length of the first conductor L1 that is to be held. The recess 3 is also of such a size that all or part of the diameter of the conductor L1 can be held.

A conductor is generally in the form of a conductor core and, possibly, conductor insulation arranged above it. This results in the conductor core having a diameter, and in the conductor insulation having a diameter. When the conductor L1 is held in the contact piece 1, the holding of the conductor core, that is to say of the associated diameter, is of major relevance. Any spring effect that is produced by the limbs 5 can be used for effective contact when the conductor is clamped in, depending on the sizes of the recess 3, of the limbs 5 and the diameter of the conductor core.

If a force K is applied to the conductor L1 positioned in this way, at right angles or approximately at right angles to the base body 2, the longitudinal edge 4 results in the insulation on the conductor L1 being interrupted. The insulation is accordingly torn into along the conductor L1 and, under the influence of the force K which is applied, is displaced partially to the side of the conductor core, in the direction in which the force is acting and partially into the cutout 3, and, possibly, with part of it being pinched away.

The longitudinal edge 4 may also be provided on both longitudinal sides of the recess 3, with different edge shapes and embodiments, such as a sawtooth, a corrugated or else a blade edge being possible. When the conductor L1 is held in this way, the limbs 5 of the base body 2 which are formed by the recess 3 make an electrically conductive pressure connection with the first conductor L1 that is held.

Fields of use for a contact piece such as this may extend from an application for cable lugs, via use of appliances and circuit breakers, to use for a bus connection technique.

Figure 2:
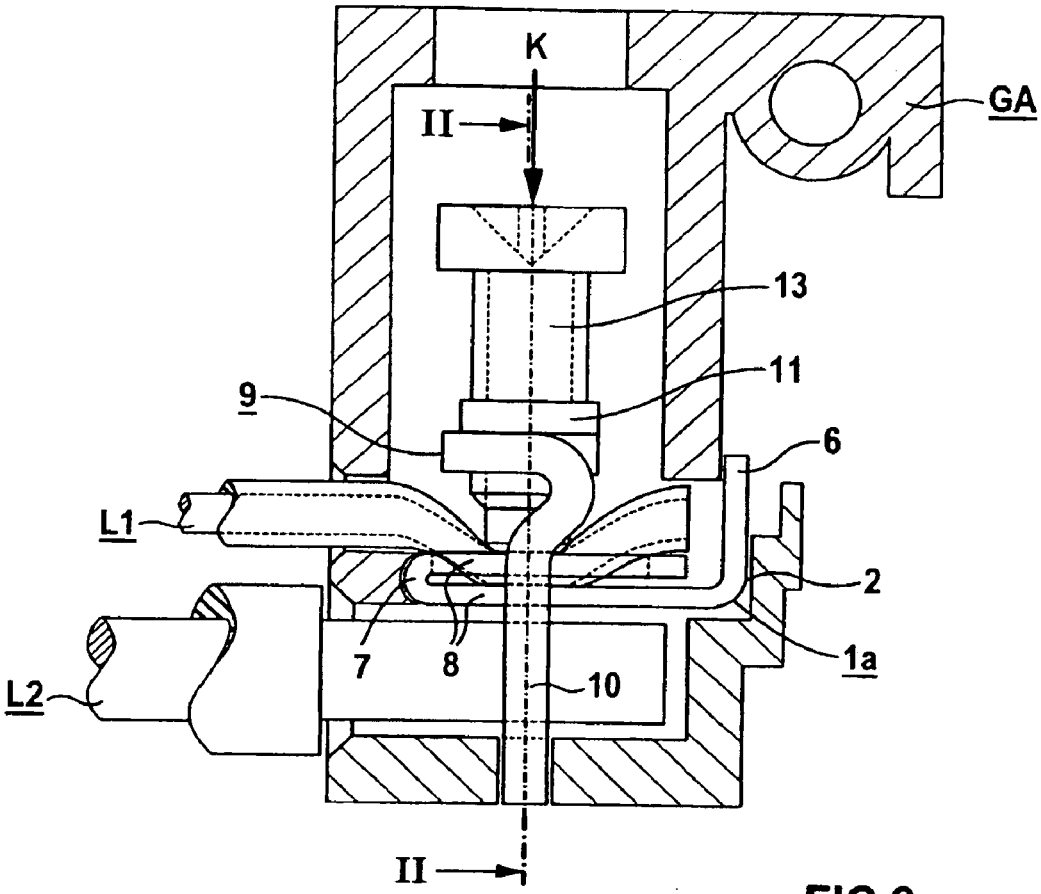
FIG. 2 shows a side view of a connecting terminal with an associated contact piece in a housing section.

By way of example, FIG. 2 shows a side view of the contact piece 1*a* associated with a connecting terminal 9, in which the connecting terminal 9 and the contact piece 1 as well are arranged in a housing section GA. The contact piece 1 may be used for any desired type and form of terminal, for example for a blade connecting terminal or flat terminal, or a female connector or clip terminal, and for a clamp-type terminal. The housing section GA may be part of a terminal, switch or circuit breaker housing or, possibly, may be part of a housing of a DIN rail mounted device.

The connecting terminal 9 illustrated here has a terminal frame 10 which is formed from a material in the form of a strip and is designed on the guidance side so as to produce a spring effect. As an alternative to this, the terminal frame 10 may also be designed with a conventional profile, which is distinguished by having an essentially linear profile. The terminal frame 10 is provided with an internal cutout 12, which is used as a holding space for at least one first conductor L1. A contact piece 1*a* is arranged, corresponding to the above statements, in the terminal frame 10, which has a single-limbed profile.

On one side, a terminal frame 10 has a guide 11 for a clamping technology 13 that is arranged in it, in particular a clamping screw, and is provided on a different side, which is opposite the first side, with a rest 14 for the first conductor L1, with this rest 14 being formed by an internal surface of the cutout 12. The clamping technology 13 extend from the guide 11 in the direction of the rest 14 and, in the area of the rest 14, essentially in the plane of the limb.

The base body 2 of the contact piece 1*a* has a connecting element 6 for connection purposes. The connecting element 6 is in the form of an L-shaped projection on the base body 2 and is used for interlocking and/or force-fitting connection to a further electrical conductor or to a further component. If required, the connecting element 6 may have a shape that is matched to the housing shape.

The clamping technology 13 which are arranged on the terminal frame 10 fix the first insulated conductor L1 at least in a force-fitting and electrically conductive manner in the recess, with the insulation of this conductor L1 being interrupted. The clamping technology 13 may in this case be in the form of a clamping screw, lever, eccentric, or in the form of a clamping bolt or striker.

In order to strengthen the base body 2, it has at least one fold, with the fold being U-shaped and the two elements 8 which are produced in this way being arranged parallel to one another and virtually one on top of the other. The elements 8 of the base body 2 are located in the cutout 12 approximately centrally underneath the clamping technology 13, with the latter acting orthogonally on one of the two elements 8. The recess 3, which is aligned transversely with respect to the single-limbed profile, is arranged in the side of the contact piece 1*a* facing the guide 11, such that the clamping technology 13 acts on the centre of a contact zone of the contact piece 1. The recess 3 is incorporated in one limb 5 of the base body 2.

The terminal frame 10 has an additional holding space for a second conductor L2 between a lower face of the contact piece 1*a* and the rest 14. This conductor L2 will generally have had its insulation stripped off it before it is inserted into the terminal frame 10, and can be clamped in a conventional manner. The second conductor L2 may also be clamped independently of the first conductor L1. The clamping is provided by what is referred to as an elevator principle, in which the clamping technology 13 and the contact piece 1*a* are locked in position, but the terminal frame 10 is moved —in a similar way to an elevator, that is to say along a defined path—in the direction of the clamping technology 13 against a pressure piece, or else against an incline.

Figure 3:
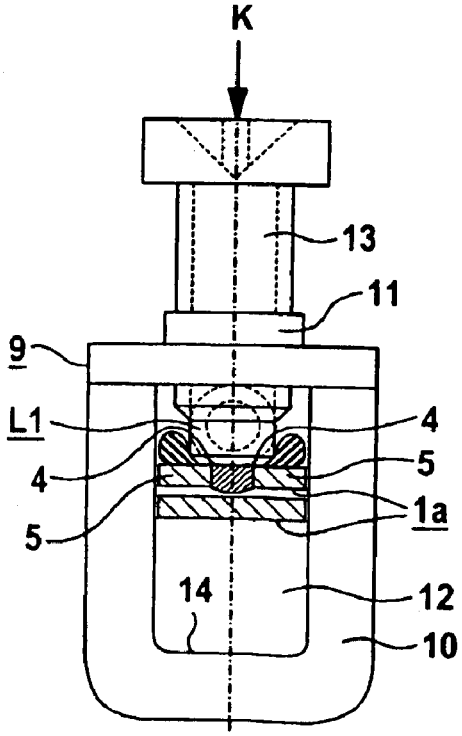
FIG. 3 shows a front view of a contact piece which is arranged in a connecting terminal.

FIG. 3 shows a front view of the connecting terminal 9 with an associated contact piece 1*a,* with the first conductor L1—illustrated by dashed lines—being introduced first of all. The illustration also shows the interrupted and displaced insulation of the conductor L1 at the side of the clamping technology 13, as well as the conductor core, which has been pushed in and is thus clamped. The force K which acts on the first conductor L1 via the clamping technology 13 may in some circumstances also interrupt the insulation of the conductor L1, which is arranged immediately underneath the clamping technology 13, hence displacing this insulation, thus producing a further contact. FIG. 3 can also alternatively be interpreted as a side view of a conventional terminal frame. In this case, the terminal frame is formed from bent strip material.

Figure 4:
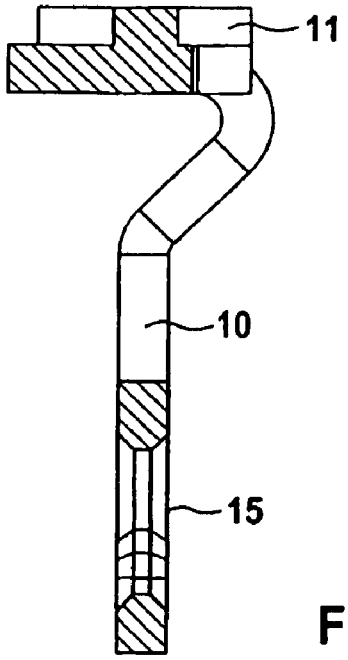
FIGS. 4 and 5 show a side view and a front view, respectively, of a connecting terminal having at least one further cutout.
Figure 5:
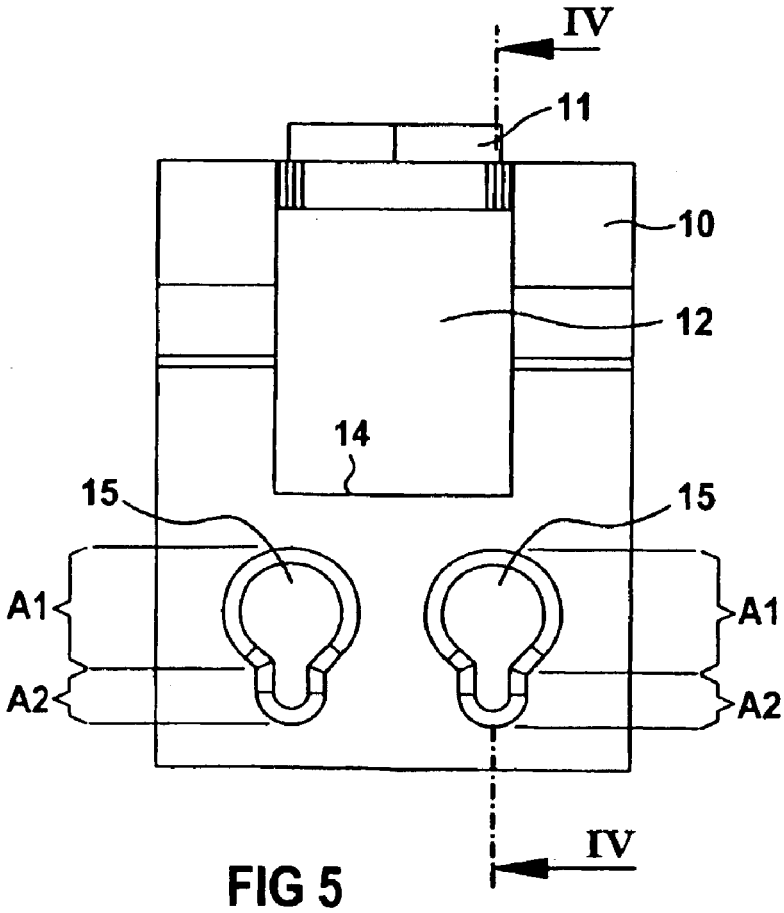

FIGS. 4 and 5 respectively show a side view and a front view of the connecting terminal 9 without any clamping technology but with at least one further cutout 15, which is used as a holding space. Simple lengthening of the terminal frame 10 of the connecting terminal 9 on the limb side first of all results in insertion protection for conductors, and secondly results in additional space for further functions. The connecting terminal A has a first section A1 for a conductor that is to be inserted, and a second, tapered section A2, adjacent to the first section A1. This further cutout 15 is at least approximately in the form of a keyhole.

The diameter of this second section A2 is of such a size that, when the clamping technology 13 are activated, the insulation on the conductor to be inserted is interrupted on its flanks, and an electrically conductive contact is made between the base body 2 and the conductor core. The second section A2 may be provided with blades, edges or else with a tooth system in order to interrupt the conductor insulation better.

The conductor to be inserted can be clamped independently of the first or second conductor L1, L2. The clamping is provided by way of what is referred to as an elevator principle, in which the clamping technology 13 is locked in its position, but the terminal frame 10 is moved—in a similar way to an elevator, that is to say along a defined path—in the direction of the clamping technology 13 against a pressure piece, or else against an incline. The conductor to be inserted is in consequence necessarily pushed by the first section A1 into the second section A2, the conductor insulation is cut through, and contact is made with the conductor core.

Exemplary embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A device, comprising:

a contact piece having a base body which has a recess for holding a first conductor, wherein the recess is designed in the form of an elongated hole or elongated groove and to hold at least part of the length of the first conductor, at least one longitudinal edge of the recess is designed to interrupt and insulation on the first conductor, and limbs of the base body which are formed by the recess form an electrically conductive pressure connection with the first conductor when it is in place.

2. The device according to claim 1, wherein the recess is of such a size that the first conductor is held one of partially and completely.

3. The device according to claim 1, wherein the recess is designed to be closed or open.

4. The device according to claim 1, wherein a connecting element for connection purposes is arranged on the base body.

5. The device according to claim 1, wherein the base body is formed by an electrically conductive material.

6. The device according to claim 5, wherein the base body has at least one fold.

7. A connecting terminal having a contact piece as claimed in claim 1, the connecting terminal comprising:

a terminal frame which has an internal cutout, which is used as a holding space for at least one first conductor, wherein a clamping technology is arranged on the terminal frame and fixes an insulated first conductor which is to be inserted, at least in a force-fitting and electrically conductive manner in the recess, the insulation thereof being interrupted.

8. The connecting terminal according to claim 7, wherein the terminal frame has a single-limbed profile.

9. The connecting terminal according to claim 7, wherein the clamping technology is in the form of one of a clamping screw and a lever.

10. The connecting terminal according to claim 7, wherein the terminal frame is provided with at least one further cutout, which is used as a holding space and has a first section for insertion of a further insulating conductor and a second tapered section, which is adjacent to the first section and whose diameter is of such a size that, when the clamping technology are activated, the insulation of the further conductor is interrupted on flanks thereof, and an electrically conductive contact is made between the base body and the further conductor.

11. The connecting terminal according to claim 10, wherein the further cutout is at least approximately in the form of a keyhole.

12. A method for making contact between a first conductor and a contact piece, the method comprising:

aligning the first conductor longitudinally with respect to the recess, which is in the form of an elongated hole, or elongated groove;

exerting a force with a clamping technology on the first conductor and on an insulation thereof in a direction approximately at right angles to the longitudinal axis of the recess;

interrupting the insulation on the first conductor on at least one longitudinal edge of the recess, contacting an electrically conductive part of the first conductor with at least one longitudinal edge of the recess, so that an electrically conductive connection is made; and forming with limbs of the base body by the recess of an electrically conductive pressure connection with the first conductor when it is in place.

13. The device according to claim 3, wherein the recess is of such a size that the first conductor is held one of partially and completely.

14. The device according to claim 4, wherein the recess is of such a size that the first conductor is held one of partially and completely.

15. The connecting terminal according to claim 8, wherein the terminal frame is provided with at least one further cutout, which is used as a holding space and has a first section for insertion of a further insulating conductor and a second tapered section, which is adjacent to the first section and whose diameter is of such a size that, when the clamping technology are activated, the insulation of the further conductor is interrupted on flanks thereof, and an electrically conductive contact is made between the base body and the further conductor.

16. The connecting terminal according to claim 9, wherein the terminal frame is provided with at least one further cutout, which is used as a holding space and has a first section for insertion of a further insulating conductor and a second tapered section, which is adjacent to the first section and whose diameter is of such a size that, when the clamping technology are activated, the insulation of the further conductor is interrupted on flanks thereof, and an electrically conductive contact is made between the base body and the further conductor.

* * * * *